US011125416B2

(12) United States Patent
Kawano

(10) Patent No.: US 11,125,416 B2
(45) Date of Patent: Sep. 21, 2021

(54) LIGHTING DEVICE

(71) Applicant: Midori Kawano, Tokyo (JP)

(72) Inventor: Midori Kawano, Tokyo (JP)

( * ) Notice: Subject to any disclaimer, the term of this patent is extended or adjusted under 35 U.S.C. 154(b) by 0 days.

(21) Appl. No.: 17/047,948

(22) PCT Filed: Apr. 15, 2019

(86) PCT No.: PCT/JP2019/016192
§ 371 (c)(1),
(2) Date: Oct. 15, 2020

(87) PCT Pub. No.: WO2019/203196
PCT Pub. Date: Oct. 24, 2019

(65) Prior Publication Data

US 2021/0156543 A1 May 27, 2021

(30) Foreign Application Priority Data

Apr. 16, 2018 (JP) ..... JP2018-078306

(51) Int. Cl.
*F21V 14/02* (2006.01)
*F21S 8/06* (2006.01)
(Continued)

(52) U.S. Cl.
CPC ..... *F21V 14/02* (2013.01); *F21S 8/061* (2013.01); *F21V 9/083* (2013.01); *F21Y 2115/10* (2016.08)

(58) Field of Classification Search
CPC .... F21S 8/06; F21S 8/061; F21V 9/08; F21V 9/40; F21V 9/30; F21V 9/45; F21V 14/00; F21L 15/04
See application file for complete search history.

(56) References Cited

U.S. PATENT DOCUMENTS 4,138,714 A 2/1979 Tsuchihashi et al.
4,233,654 A * 11/1980 Tsuchihashi ..... G09F 19/20 362/231
(Continued)

FOREIGN PATENT DOCUMENTS

JP S53125379 A 11/1978
JP H06-068205 U 9/1994
(Continued)

OTHER PUBLICATIONS

English Translation of International Search Report from PCT/JP2019/016192 dated Jun. 25, 2019 (1 page).

*Primary Examiner* — William N Harris
(74) *Attorney, Agent, or Firm* — Calfee, Halter & Griswold LLP

(57) ABSTRACT

To provide a lighting device capable of producing a more unique space, and particularly to provide a lighting device in which, when an exhibit or the like (an article) is arranged in portions where spot lights to be respectively irradiated from light projection means interfere with each other, two or more shadows having different hues appear from the exhibit or the like (the article) while the exhibit or the like (the article) is being illuminated with a monochromatic light, the lighting device has a function of irradiating respective spot lights in two or more colors, and includes two or more light projection means for respectively irradiating the spot lights, in which the light projection means are respectively provided at positions spaced 5 cm or more apart from each other, and the spot lights to be irradiated from the light projection means respectively include portions that interfere with each other.

13 Claims, 6 Drawing Sheets

(51) Int. Cl.
*F21V 9/08* (2018.01)
*F21Y 115/10* (2016.01)

(56) References Cited

U.S. PATENT DOCUMENTS

| | | | | |
|---|---|---|---|---|
| 2006/0262521 | A1* | 11/2006 | Piepgras | F21V 29/83 362/149 |
| 2013/0293722 | A1* | 11/2013 | Chen | F21V 5/02 348/164 |
| 2015/0023019 | A1* | 1/2015 | Chen | H05B 47/115 362/276 |
| 2015/0192274 | A1* | 7/2015 | Kubis | F21S 10/023 362/231 |
| 2016/0076736 | A1* | 3/2016 | Van Bommel | G01N 21/6428 435/29 |
| 2019/0331330 | A1* | 10/2019 | Chen | G01J 5/0025 |

FOREIGN PATENT DOCUMENTS

| | | | |
|---|---|---|---|
| JP | 2002-373507 | A | 12/2002 |
| JP | 2008-258066 | A | 10/2008 |
| JP | 2011-009059 | A | 1/2011 |
| JP | 2011-170296 | A | 9/2011 |
| JP | 2013-114965 | A | 6/2013 |
| JP | 2013-171777 | A | 9/2013 |
| JP | 2014-130746 | A | 7/2014 |
| JP | 2016-161882 | A | 9/2016 |

* cited by examiner

FIGURE 4B ENLARGE ALONG A - A

FIGURE 5C ENLARGE ALONG B - B

LIGHTING DEVICE

TECHNICAL FIELD

The present invention relates to a lighting device.

BACKGROUND ART

It has been known that an impression of an exhibit itself can be enhanced by a lighting device that produces a space.

As the lighting device that produces a space, a light projector capable of projecting both a video light and an illumination light (Patent Literatures 1), a light projector capable of projecting a light having a specific shape (Patent Literature 2), and a lighting device capable of irradiating a plurality of types of lights (Patent Literatures 3) have been known, for example.

A technique for reducing color unevenness by arranging a plurality of LEDs to substantially closely contact one another has been known (Patent Literatures 4 and Patent Literature 5).

Patent Literature 6 discloses a technique for reducing color unevenness by arranging on a substrate a plurality of LED groups each including a set of LEDs arranged in a specific pattern.

CITATION LIST

Patent Literature

Patent Literature 1: Japanese Patent Laid-Open No. 2016-161882

Patent Literature 2: Japanese Patent Laid-Open No. 2011-170296

Patent Literature 3: Japanese Patent Laid-Open No. 2013-171777

Patent Literature 4: Japanese Patent Laid-Open No. 2002-373507

Patent Literature 5: Japanese Patent Laid-Open No. 2014-130746

Patent Literature 6: Japanese Patent Laid-Open No. 2013-114965

SUMMARY OF INVENTION

In the above-described background, a further development of a lighting device capable of producing a more unique space has been required.

An object of the invention made in view of the above-described circumstances is to provide a lighting device capable of producing a more unique space.

Particularly, an object of the present invention is to provide a lighting device in which, when an exhibit or the like (an article) is arranged in portions where spot lights to be respectively irradiated from light projection means interfere with each other, two or more shadows having different hues appear from the exhibit or the like (the article) while the exhibit or the like (the article) is being illuminated with a monochromatic light.

The present invention made in view of the above-described circumstances is directed to a lighting device having a function of irradiating respective spot lights in two or more colors, the light device including two or more light projection means for respectively irradiating the spot lights, wherein the light projection means are respectively provided at positions spaced 5 cm or more apart from each other, and the spot lights to be irradiated from the light projection means respectively include portions that interfere with each other.

With the lighting device according to the present invention, such a unique space can be produced where, when an exhibit or the like (an article) is arranged in the portions where the spot lights to be respectively irradiated from the light projection means interfere with each other, two or more shadows having different hues appear from the exhibit or the like (the article) while the exhibit or the like (the article) is being illuminated with a monochromatic light (see FIGS. 2 and 6).

In the present specification, "spot light" means a light ray having directivity sufficient to find a contour of the light irradiated onto the ground, when a light is irradiated onto the ground from a height of 60 cm to 70 cm above the ground.

In the specification, "light projection means for irradiating spot light" means light projection means having a function of irradiating a spot light. With light projection means capable of adjusting a light quantity, light projection means capable of setting an output (a light quantity) in which a light ray becomes a spot light are referred to as "light projection means for irradiating spot light".

When the lighting device is configured to include the two or more light projection means for respectively irradiating the spot lights, the two or more shadows having different hues clearly appear.

In a preferred embodiment of the present invention, each of the light projection means is an LED.

When each of the light projection means is an LED, the two or more shadows having different hues appear more clearly.

Accordingly, with the lighting device in which each of the light projection means is an LED, such a unique space can be produced where, when the exhibit or the like (the article) is arranged in portions where the spot lights to be respectively irradiated from the light projection means interfere with each other, the two or more shadows having different hues clearly appear while the exhibit or the like (the article) is being illuminated with a monochromatic spot light (a mixed color light 22) (see FIGS. 2 and 6).

In the preferred embodiment of the present invention, contours of the spot lights to be irradiated from the light projection means respectively include portions that substantially match each other.

With the lighting device having such a form, such a unique space can be produced where, when the exhibit or the like (the article) is arranged in the portions where the contours of the spot lights to be respectively irradiated from the light projection means substantially match each other, the two or more shadows having different hues appear from the exhibit or the like (the article) while the exhibit or the like (the article) is being illuminated with the monochromatic spot light (see FIGS. 2 and 6).

In the preferred embodiment of the present invention, a difference in light quantity between each of RGB colors in an RGB color model in a mixed color light of all the spot lights to be respectively projected from the light projection means is within a range of 0% to 35%.

With the lighting device having such a form, such a unique space can be produced where, when the exhibit or the like (the article) is arranged in the portions where the spot lights to be respectively irradiated from the light projection means interfere with each other, the two or more shadows having different hues appear from the exhibit or the like (the article) while the exhibit or the like (the article) is being illuminated with a pale light (a light having a low saturation) (see FIGS. 2 and 6).

In the preferred embodiment of the present invention, the lighting device is of a suspension type, and the interference of the spot lights to be respectively irradiated from the light projection means is directly below the lighting device.

With the lighting device having such a form, such a unique space can be produced where, when the exhibit or the like (the article) arranged directly below the lighting device is illuminated, the two or more shadows having different hues appear from the exhibit or the like (the article) while the exhibit or the like (the article) is being illuminated with the monochromatic light (see FIGS. 2 and 6).

The present invention is directed to a plate for lighting device for arranging light projection means, the plate for lighting device including two or more openings, the openings being respectively provided at positions spaced 5 cm or more apart from each other.

According to the present invention, there can be provided a lighting device capable of producing such a unique space that, when an exhibit or the like (an article) is arranged in portions where spot lights to be respectively irradiated from light projection means interfere with each other, two or more shadows having different hues appear from the exhibit or the like (the article) while the exhibit or the like (the article) is being illuminated with a monochromatic light (see FIGS. 2 and 6).

BRIEF DESCRIPTION OF DRAWINGS

FIG. 4B is an enlarged schematic view taken along a line A-A illustrated in FIG. 4A.

FIG. 5C is an enlarged view taken along a line B-B illustrated in FIG. 5B.

DESCRIPTION OF EMBODIMENT

Although a lighting device 1 according to the present embodiment will be described below, it goes without saying that the technical scope of the present invention is not limited to the embodiment.

The lighting device 1 according to the present embodiment includes two or more light projection means 2 for respectively irradiating spot lights 21. The light projection means 2 are respectively provided at positions spaced 5 cm or more apart from each other (see FIGS. 1 to 6). The lighting device 1 according to the present embodiment is a lighting device having a function of respectively irradiating spot lights in two or more colors using the two or more light projection means 2. The spot lights to be irradiated from the light projection means 2 respectively include portions that interfere with each other (see FIGS. 1 to 6).

Figure 2:
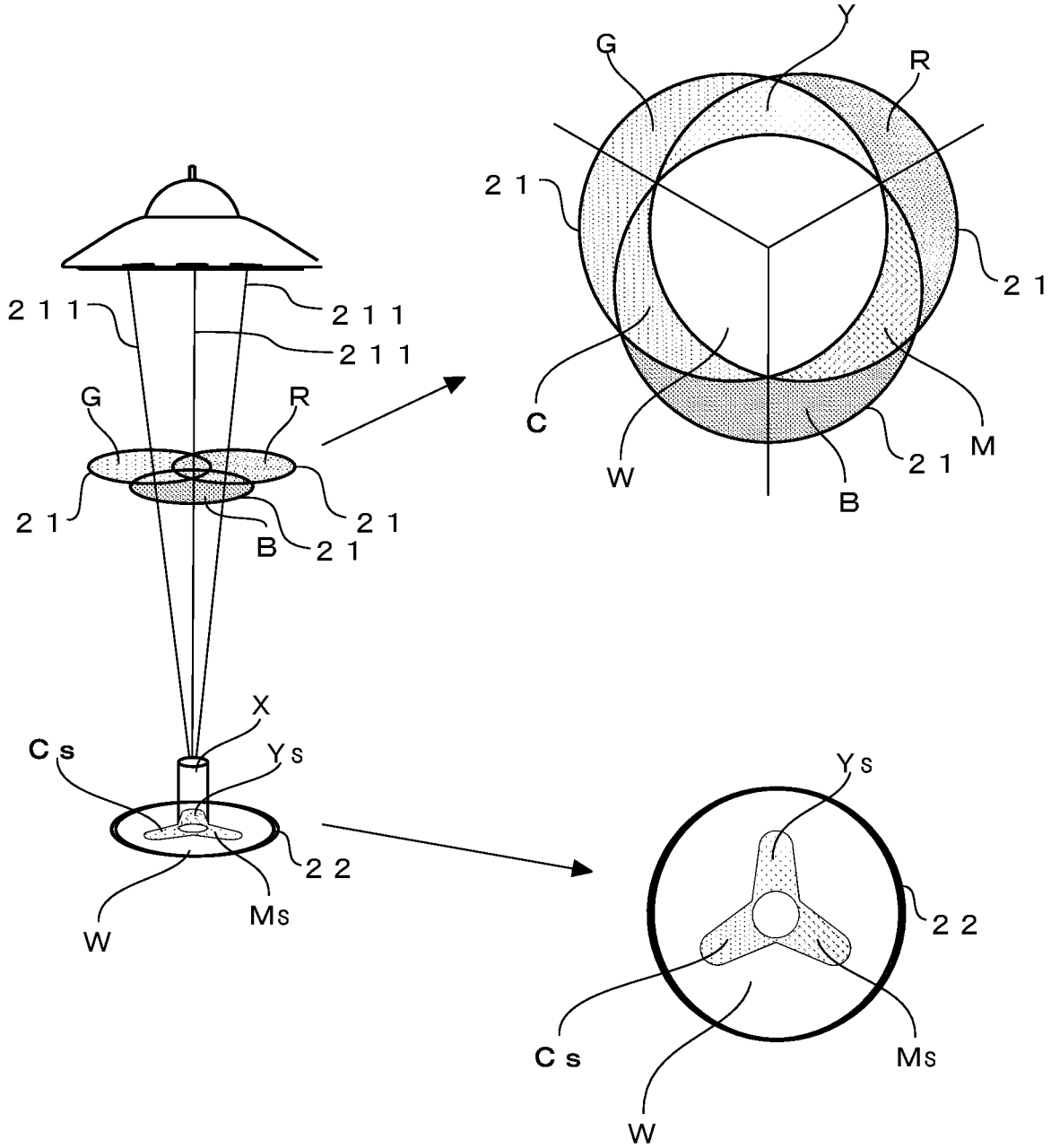
FIG. 2 is a reference schematic view illustrating how shadows of an exhibit or the like (an article) appear when the exhibit or the like (the article) is arranged in portions where spot lights to be respectively irradiated from light projection means interfere with each other using the lighting device according to the present embodiment.
Figure 6:
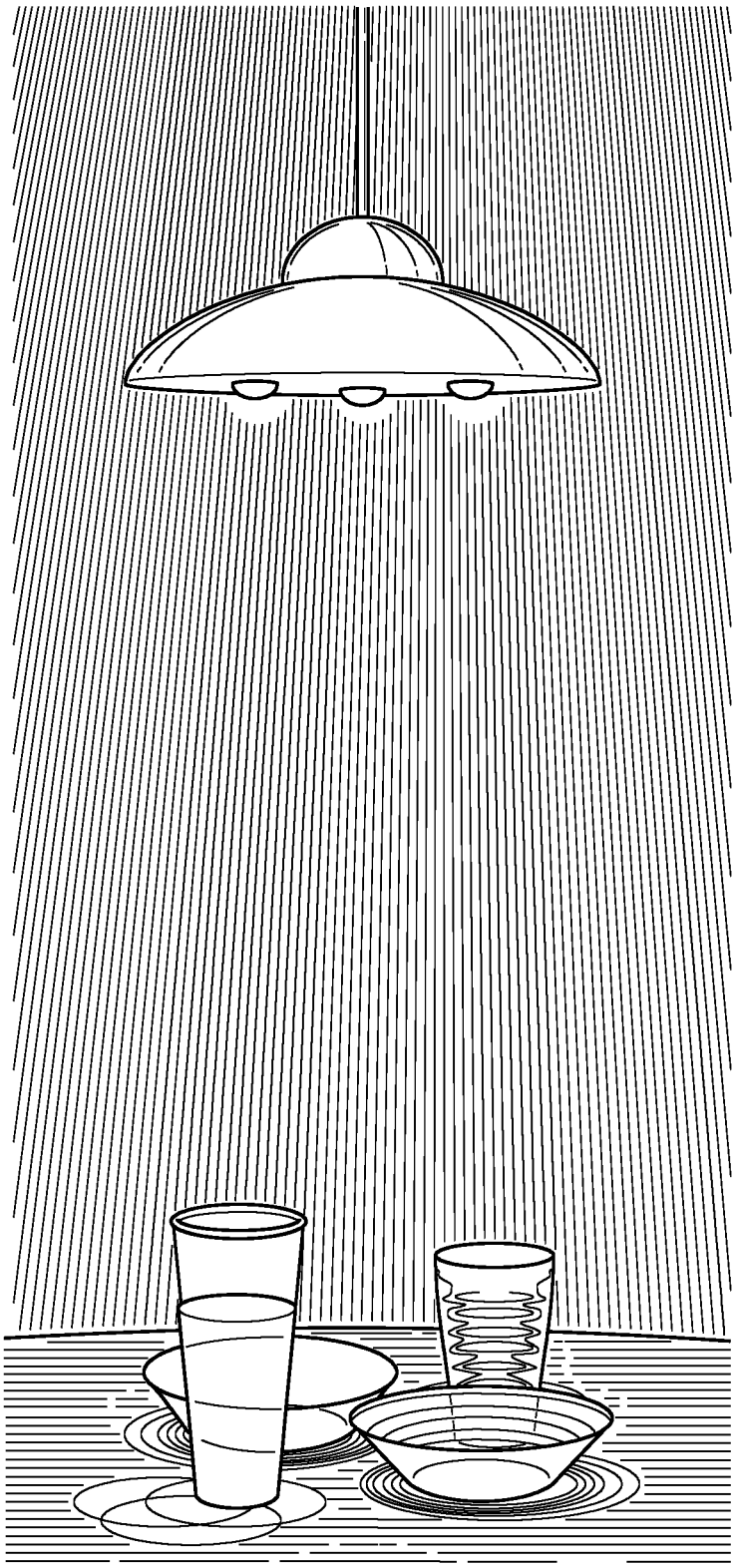
FIG. 6 is a diagram in which an exhibit is irradiated using the lighting device 1 according to the present embodiment.

With the lighting device 1 having such a configuration, such a unique space can be produced where, when an exhibit or the like (an article X) is arranged in the portions where the spot lights 21 to be respectively irradiated from the light projection means 2 interfere with each other, two or more shadows (see a cyan shadow Cs, a magenta shadow Ms, and a yellow shadow Ys) having different hues appear from the exhibit or the like (the article X) while the exhibit or the like (the article X) is being illuminated with a monochromatic light (a mixed color light 22) (see FIGS. 2 and 6).

Figure 1:
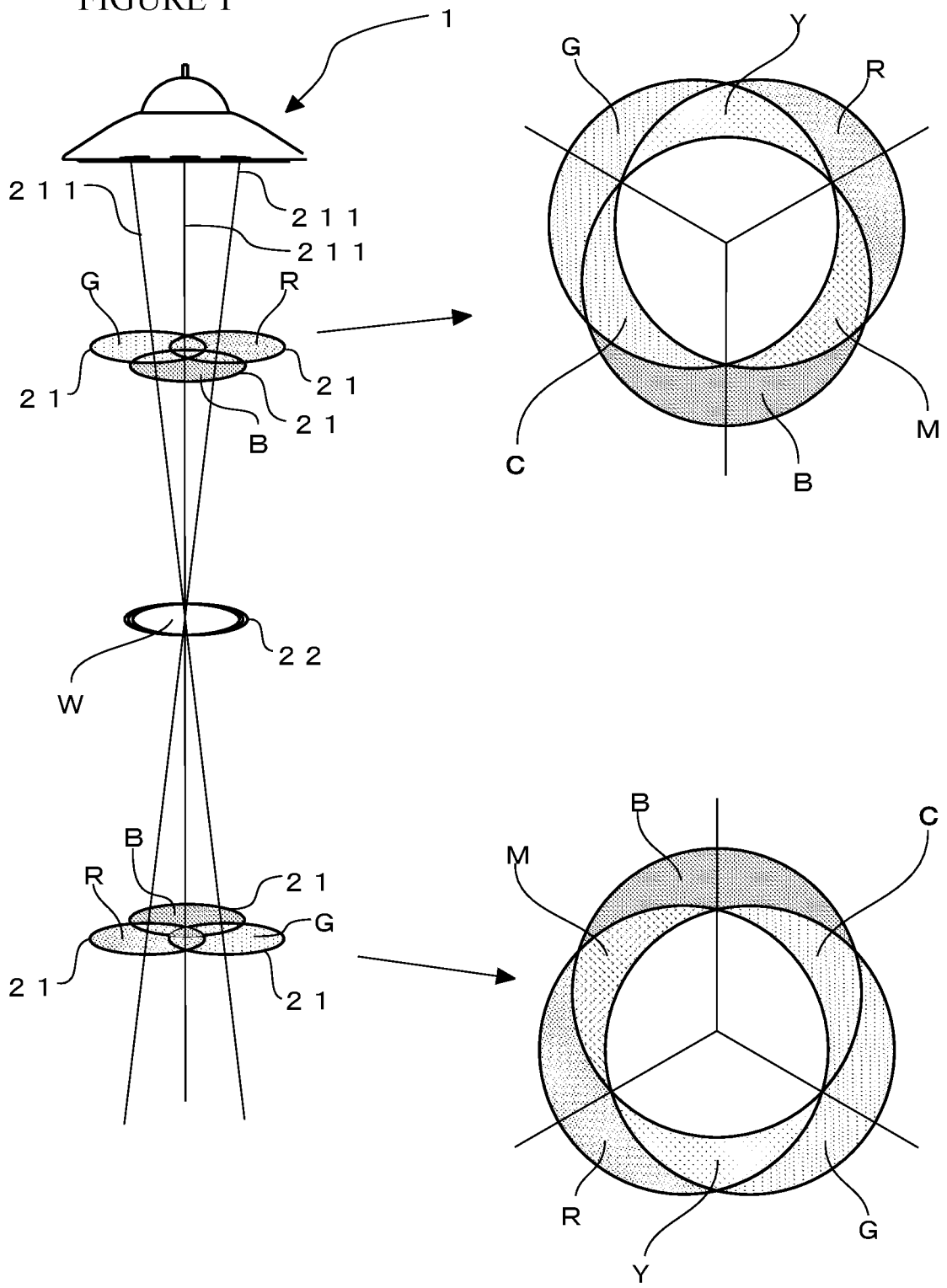
FIG. 1 is a reference schematic view of spot lights to be respectively irradiated from a lighting device according to the present embodiment.

Here, "monochromatic light (mixed color light 22)" appears when the respective spot lights 21 in two or more colors are color-mixed (see FIGS. 1, 2, and 6).

Specifically, in the lighting device 1 according to the present embodiment, respective lights in red R, green G, and blue B are color-mixed so that the monochromatic light (the mixed color light 22) becomes white W, for example (see FIGS. 1, 2, and 6).

If the respective spot lights 21 in two or more colors substantially match each other, the monochromatic light (the mixed color light 22) becomes a spot light (see FIGS. 1, 2, and 6).

"Colored shadow (one of two or more shadows having different hues)" appears when one of the spot lights 21 causes a shadow and the other spot light 21 irradiated from the other light projection means 2 having a different irradiation position and irradiation angle colors the shadow (see FIGS. 1, 2, and 6).

Specifically, in the lighting device 1 according to the present embodiment, the spot light 21 in red R causes a shadow of the exhibit or the like (the article X) and the spot lights 21 in green G and blue B respectively irradiated from the other light projection means 2 color the shadow so that the cyan shadow Cs (the colored shadow) appears, for example (see FIGS. 1, 2, and 6).

The light projection means 2 provided in the lighting device 1 according to the present embodiment will be more specifically described with reference to FIGS. 1 to 6.

In the present embodiment, each of the projection means 2 is a light emitting diode (LED) (see FIGS. 1 to 6). When each of the light projection means 2 is a light emitting diode (LED), a shadow having a clearer contour appears.

Accordingly, with the lighting device 1 in which each of the light projection means 2 is an LED, when the exhibit or the like (the article X) is arranged in the portions where the spot lights 21 to be respectively irradiated from the light projection means 2 interfere with each other, the two or more clear shadows having different hues appear from the exhibit or the like (the article X) while the exhibit or the like (the article X) is being illuminated with the monochromatic color (the mixed color light 22) (see FIGS. 2 and 6).

The type of light source of the light projection means 2 is not particularly limited, but the light source may be a halogen lamp, an HID lamp, an incandescent lamp, a silica lamp, or a mini-krypton lamp, for example.

The light projection means 2 need not necessarily be light projection means composed of a single light source, but may be light projection means including a light source composed of a collection of two or more light sources. An example of the light source composed of a collection of two or more light sources can include a light source composed of a collection of light emitting diodes in R (red), G (green), and B (blue).

When the light projection means 2 is light projection means including a light source composed of a collection of two or more light sources, the hues of the spot lights 21 that can be respectively irradiated from the light projection means 2 can be changed. Accordingly, with the lighting device including the light projection means 2 including a light source composed of a set of two or more light sources, such a more unique space can be produced where respective hues of the monochromatic color (the mixed color light 22) and the shadows (see the cyan shadow Cs, the magenta shadow Ms, and the yellow shadow Ys) can be changed (see FIGS. 1, 2, and 6).

Note that the size and the shape of the light projection means 2 are not particularly limited.

The lighting device 1 according to the present embodiment includes three light projection means 2 (see FIGS. 1 to 6).

Note that the number of light projection means provided in the lighting device is not particularly limited, but the lighting device may have a form including two or more light projection means.

In the present embodiment, the light projection means 2 are respectively provided at positions spaced 5 cm or more, more preferably 10 cm or more, and further preferably 15 cm or more apart from each other.

Such a form is more preferable because the two or more shadows (see the cyan shadow Cs, the magenta shadow Ms, and the yellow shadow Ys) having different hues appear from the exhibit or the like (the article X) and the two or more shadows (see the cyan shadow Cs, the magenta shadow Ms, and the yellow shadow Ys) having different hues respectively appear at positions more spaced apart from each other (see FIGS. 1, 2, and 6).

The light projection means 2 are respectively provided at positions spaced preferably 50 cm or less, more preferably 45 cm or less, and further preferably 40 cm or less apart from each other.

The lighting device 1 according to the present embodiment includes the three light projection means 2 on a substantially identical circumference of the lighting device 1. With such a form including the light projection means 2 on the substantially identical circumference of the lighting device 1, such a more unique space can be produced where the two or more shadows (see the cyan shadow Cs, the magenta shadow Ms, and the yellow shadow Ys) having different hues appear from the exhibit or the like (the article X), respectively, at symmetrical positions (see FIGS. 1, 2, and 6).

In the present embodiment, each of the light projection means 2 is inclined by 3 degrees to 15 degrees in a direction of an axis passing through the respective centers of all the light projection means 2. With such a form, such a more unique space can be produced where, when the exhibit or the like (the article X) is arranged on the axis passing through the respective centers of all the light projection means 2, the two or more shadows (see the cyan shadow Cs, the magenta shadow Ms, and the yellow shadow Ys) having different hues appear from the exhibit or the like (the article X) while the exhibit or the like (the article X) is being illuminated with the monochromatic light (the mixed color light 22) (see FIGS. 1, 2, and 6).

Note that the degree of the inclination of the light projection means 2 is not particularly limited.

The spot lights 21 to be respectively irradiated by the light projection means 2 provided in the lighting device 1 according to the present embodiment will be more specifically described below with reference to FIGS. 1 to 6.

In the present embodiment, the spot lights 21 to be irradiated by the three light projection means 2 are respectively red R, green G, and blue B. Note that the hue of the spot light 21 to be irradiated by each of the light projection means 2 is not particularly limited.

In the present embodiment, the hues of the spot lights 21 to be irradiated by the light projection means 2 are respectively determined by color lenses 31 provided in a plate for lighting device 3.

Note that the hue of the spot light 21 may be due to a luminescent color of the light projection means 2.

A shape of a contour of a light irradiated onto the ground when the spot light 21 is irradiated onto the ground from a height of 60 cm to 70 cm above the ground is not particularly limited, but may be any one of a substantially circular shape, a substantially trapezoidal shape, and a substantially square shape.

Note that the spot light 21 need not necessarily be a light that is clear enough to specify the shape of the contour of the light.

The contours of the spot lights 21 to be irradiated from the light projection means 2 in the present embodiment respectively include portions that substantially match each other (see FIG. 1 (the mixed color light 22) and FIG. 6).

With the lighting device 1 having such a form, such a unique space can be produced where, when the exhibit or the like (the article X) is arranged in the portions where the contours of the spot lights 21 to be respectively irradiated from the light projection means 2 substantially match each other, the two or more shadows (see the cyan shadow Cs, the magenta shadow Ms, and the yellow shadow Ys) having different hues appear from the exhibit or the like (the article X) while the exhibit or the like (the article X) is being illuminated with the monochromatic spot light (the mixed color light 22) (see FIGS. 1, 2, and 6).

Note that the lighting device 1 may have a form in which the contours of the spot lights 21 to be irradiated from the light projection means 2 need not necessarily respectively have portions that substantially match each other but the spot lights 21 to be irradiated from the light projection means 2 respectively have portions that interfere with each other.

Here, "have portions that interfere with each other" means that at least parts of conductive wires of the spot lights 21 respectively irradiated from the light projection means 2 interfere with each other.

The lighting device 1 having such a configuration can produce such a unique space that, when the exhibit or the like (the article X) is arranged in the portions where the spot lights 21 to be respectively irradiated from the light projection means 2 interfere with each other, the two or more shadows (see the cyan shadow Cs, the magenta shadow Ms, and the yellow shadow Ys) having different hues appear from the exhibit or the like (the article X) while the exhibit or the like (the article X) is being illuminated with the monochromatic light (the mixed color light 22) (see FIGS. 1, 2, and 6).

Note that in the lighting device according to the present invention, optical axes 211 of the spot lights 21 to be irradiated from the light projection means 2 more preferably respectively include portions that substantially match each other (see FIGS. 1, 2, and 6).

With the lighting device having such a form, such a unique space can be produced where, when the exhibit or the like (the article X) is arranged in the portions where the optical axes of the spot lights 21 to be respectively irradiated from the light projection means 2 substantially match each other, the two or more shadows (see the cyan shadow Cs, the magenta shadow Ms, and the yellow shadow Ys) having different hues appear from the exhibit or the like (the article X) while the exhibit or the like (the article X) is being illuminated with the monochromatic spot light (the mixed color light 22) (see FIGS. 1, 2, and 6).

Note that "optical axis 211" in the present specification means a light ray passing through a substantial center of an irradiation range (see FIGS. 1 and 2).

Then, the mixed color light 22 obtained by color-mixing all the spot lights 21 to be respectively projected from the light projection means 2 will be described with reference to FIGS. 1 and 2.

Color-mixing means mixing of respective lights in two or more colors. Note that in color-mixing of lights, the lights become bright every time colors are superimposed, for example, become white when three colors, i.e., red, blue, and green are superimposed in the same light quantity.

A difference in light quantity between each of RGB colors in an RGB color model in the mixed color light 22 obtained when all the spot lights 21 to be respectively projected from the light projection means 2 are color-mixed is preferably within a range of 0% to 35%. With such a form, such a unique space can be produced where, when the exhibit or the like (the article X) is arranged in the portions where the spot lights 21 to be respectively irradiated from the light projection means 2 interfere with each other, the two or more shadows (see the cyan shadow Cs, the magenta shadow Ms, and the yellow shadow Ys) having different hues appear from the exhibit or the like (the article X) while the exhibit or the like (the article X) is being illuminated with a pale light (a light having a low saturation or the mixed color light 22) (see FIGS. 1, 2, and 6).

The RGB color model in the present specification means an RGB colorimetric system in which a light is represented by mixing three colors [R], [G], and [B] (red/green/blue).

As the light quantity of the light in each of the RGB colors in the RGB color model, a value of an amount of mixing of each of the three primary colors (a red primary color [R]=700 nm (nm=nanometer), a green primary color [G]=546.1 nm, and a blue primary color [B]=435.8 nm) can be used where respective single-wavelength lights in the three primary colors are color-mixed while being adjusted and are each matched with the target mixed color light 22 (in other words, see a color matching experiment).

Note that the light quantity of the light in each of the RGB colors in the RGB color model may be a value in the RGB colorimetric system obtained by converting a value measured using a color luminometer.

The mixed color light 22 obtained when all the spot lights 21 to be respectively projected from the light projection means 2 are mixed is more preferably white. When the mixed color light 22 is white, such a unique space can be produced where, when the exhibit or the like (the article X) is arranged in the portions where the spot lights 21 to be respectively irradiated from the light projection means 2 interfere with each other, the two or more shadows (see the cyan shadow Cs, the magenta shadow Ms, and the yellow shadow Ys) having different hues appear from the exhibit or the like (the article X) while the exhibit or the like (the article X) is being illuminated with the white light (the mixed color light 22) (see FIGS. 1, 2, and 6).

Note that the hue of the mixed color light 22 obtained when all the spot lights 21 to be respectively projected from the light projection means 2 are color-mixed is not particularly limited.

The plate for lighting device 3 provided in the lighting device 1 according to the present embodiment will be described below with reference to FIGS. 3 to 5.

The plate for lighting device 3 according to the present embodiment is a disk-shaped plate having a radius of approximately 20 cm. The plate for lighting device 3 according to the present embodiment is entirely bent by 3 degrees to 15 degrees in a direction toward the center of the lighting device 1, with the vicinity of its center as a vertex of a recess (see FIG. 5).

Figure 3A:
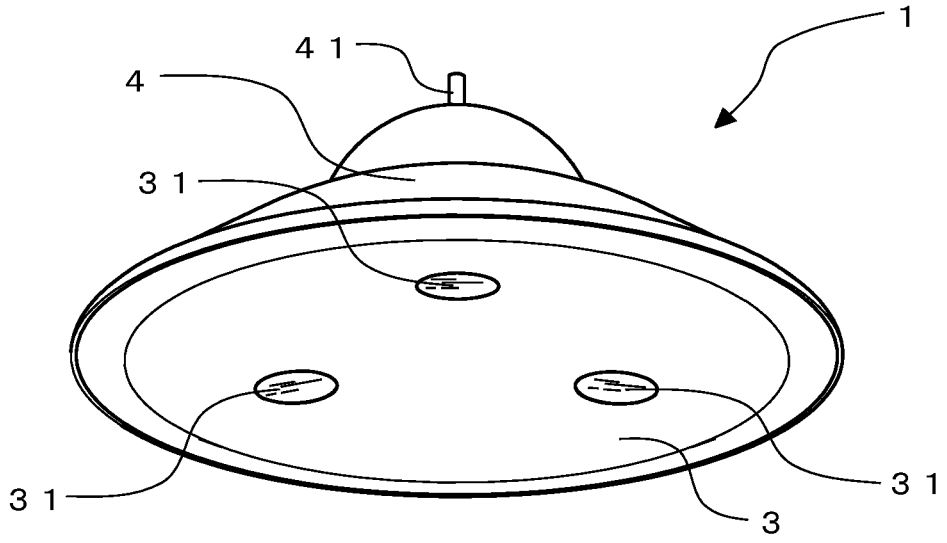
FIG. 3A is a perspective view of the lighting device according to the present embodiment.
Figure 3B:
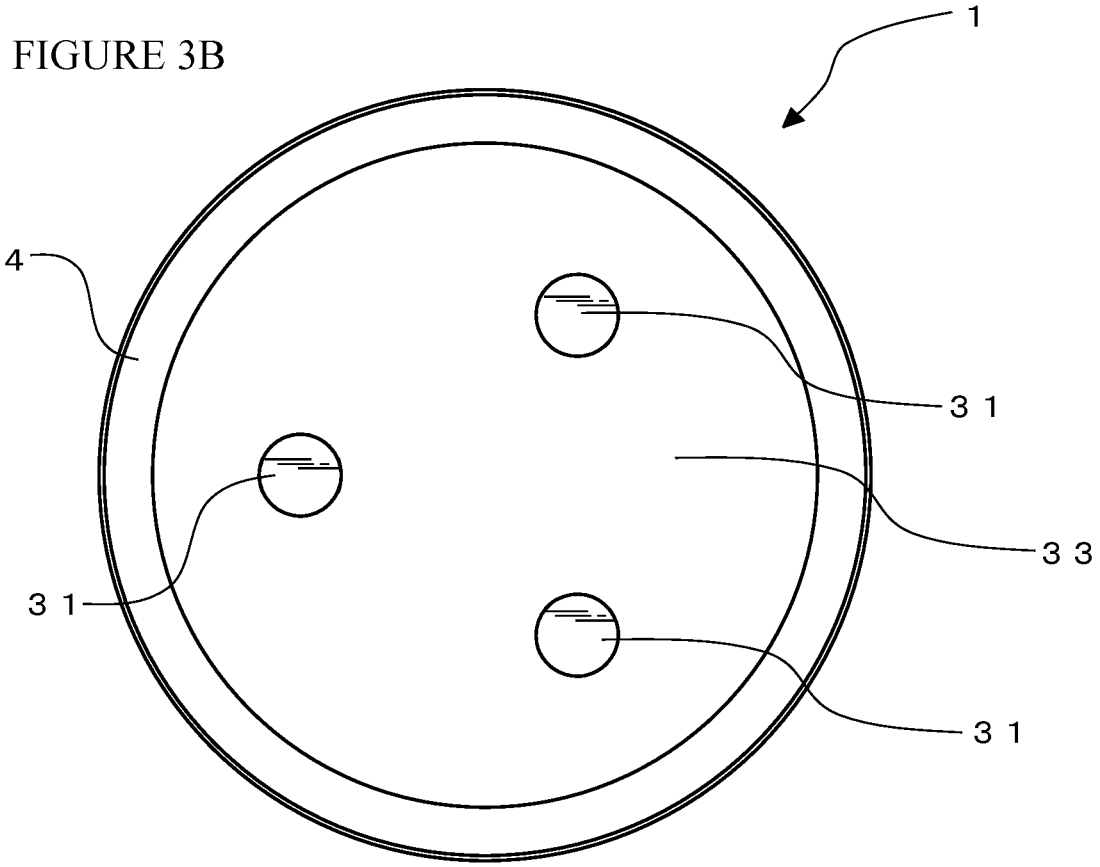
FIG. 3B is a bottom view of the lighting device according to the present embodiment.
Figure 4A:
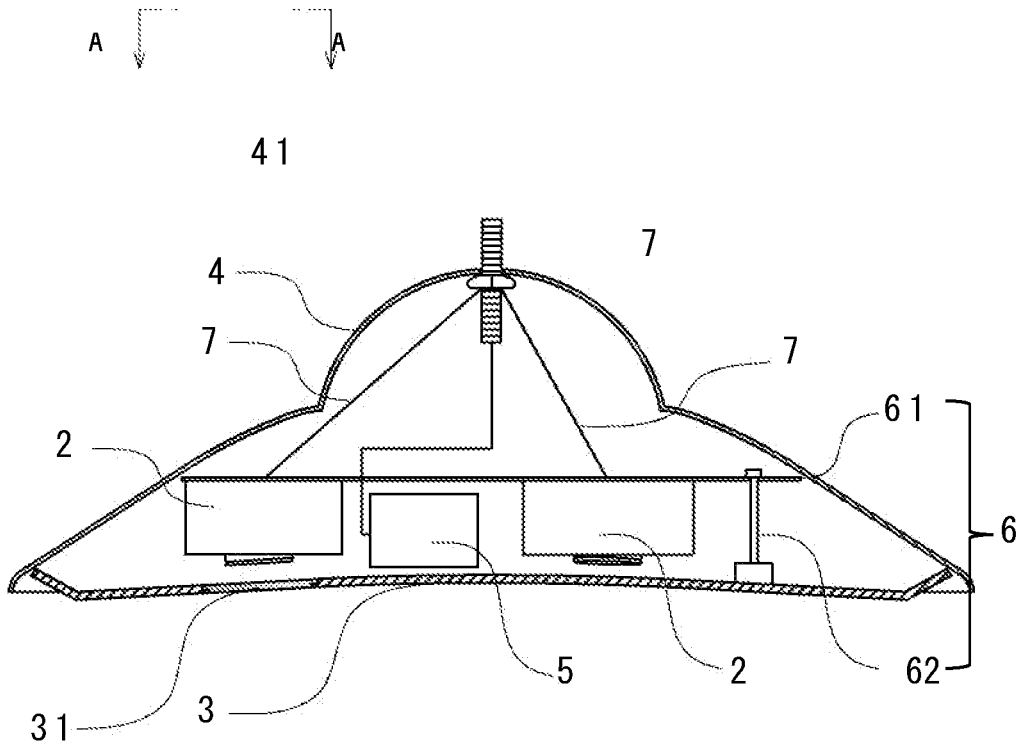
FIG. 4A is a cross-sectional view of the lighting device according to the present embodiment.
Figure 4A:
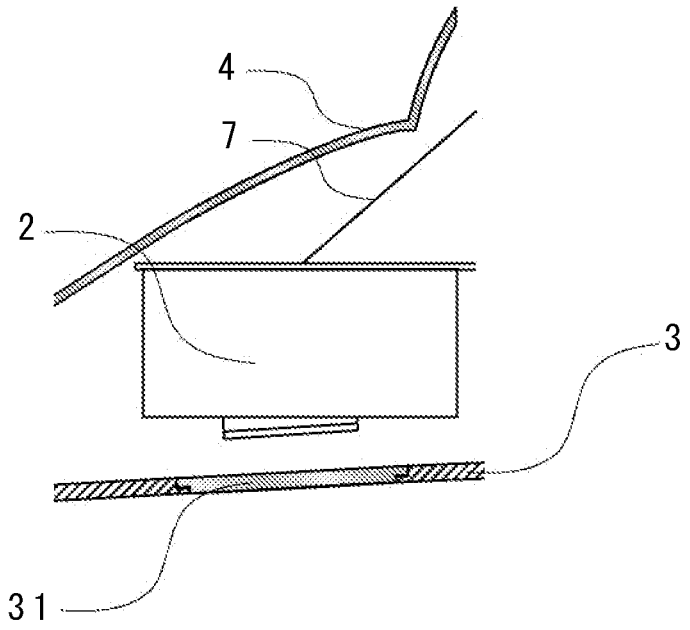
Figure 5A:
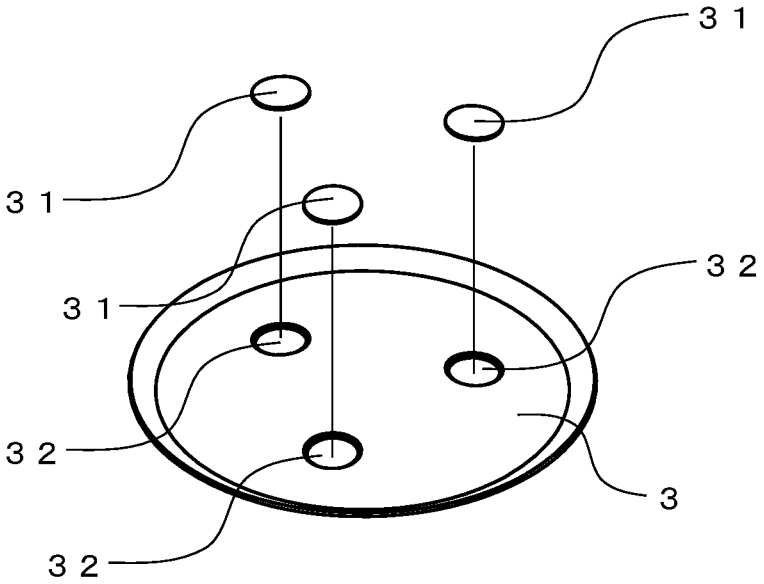
FIG. 5A is a diagram illustrating a configuration of a plate for lighting device according to the present embodiment.
Figure 5B:
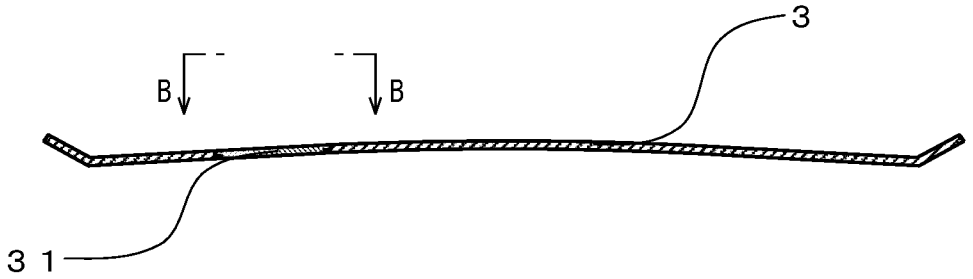
FIG. 5B is a reference cross-sectional view of the plate for lighting device according to the present embodiment.
Figure 5B:
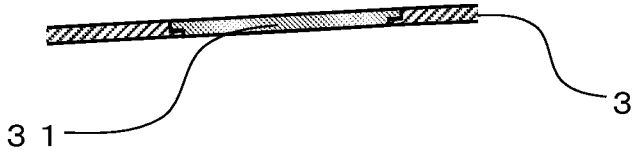

In the present embodiment, the plate for lighting device 3 has three openings 32 respectively provided at positions spaced 5 cm or more apart from one another and opposing one another (see FIGS. 3 to 5).

The plate for lighting device 3 having such a form is preferable because the spot lights 21 to be respectively irradiated from the light projection means 2 easily interfere with one another when the light projection means 2 are respectively arranged in the openings 32 in the plate for lighting device 3.

Note that the number of openings 32 provided in the plate for lighting device 3 is not limited to three, but the number of openings 32 is not particularly limited if two or more. The plate for lighting device 3 may have a form in which the openings 32 provided therein are respectively provided at positions spaced 5 cm or more, more preferably 10 cm or more, and further preferably 15 cm or more apart from each other.

The bending of the plate for lighting device 3 need not necessarily be constant.

The plate for lighting device 3 and the light projection means 2 are fixed to each other by a supporting section 6 (a support plate 61 and a support rod 62). With such a form, an arrangement and a direction of the light projection means 2 can be simply fixed.

An umbrella section 4 provided in the lighting device 1 according to the present embodiment will be described below with reference to FIGS. 3 to 5.

In the present embodiment, the umbrella section 4 includes a suspension member 41.

Wirings 7 respectively extending from the light projection means 2 and the converter 5 are connected to the suspension member 41 (FIGS. 3 to 5). With such a form, the suspension member 41 can serve as the wirings 7, and can be therefore efficiently connected to a power supply (an outlet, etc.).

The umbrella section 4 is preferably turnable with the suspension member 41 used as an axis. With such a form, a shadow appearing from the exhibit or the like (the article X) can be turned. Accordingly, a unique space can be produced (see FIGS. 1, 2, and 6). Note that if the lighting device 1 is turnable, its means is not particularly limited.

The lighting device according to the present invention need not necessarily have a form including the umbrella section 4 including the suspension member 41, but may be a suspension type lighting device.

If the lighting device 1 is a suspension-type lighting device, the lighting device 1 preferably has a configuration in which interference of the spot lights 21 to be respectively irradiated from light projection means 2 occurs directly below the lighting device 1.

When the lighting device 1 is the suspension-type lighting device and the interference of the spot lights 21 to be respectively irradiated from the light projection means 2 occurs directly below the lighting device 1, the monochromatic light (the mixed color light 22) can be irradiated onto the exhibit or the like (the article X) arranged on a floor surface, which is suitable for exhibition of a commodity.

When the interference of the spot lights to be respectively irradiated from the light projection means 2 occurs directly below the lighting device 1, such a unique space can be produced where, when the exhibit or the like (the article X) is arranged directly below the lighting device 1, the two or more shadows (see the cyan shadow Cs, the magenta shadow Ms, and the yellow shadow Ys) having different hues respectively appear at positions more spaced apart from each other while the exhibit or the like (the article X) is being illuminated with the monochromatic light (the mixed color light 22) (see FIGS. 1, 2, and 6).

Test Example

A manufacture example and an irradiation example of the lighting device 1 according to the present embodiment are illustrated below to provide an understanding of an effect of the present invention.

(1) Manufacture of Lighting Device 1 According to Present Embodiment (1-1) Manufacture of Plate for Lighting Device 3

First, a disk-shaped plate having a radius of approximately 20 cm was prepared. Here, the plate is entirely bent with the vicinity of its center as a vertex of a bulge.

Then, three openings 32 were formed in the prepared plate. The three openings 32 were formed such that a distance among the openings 32 is 15 cm to 20 cm and the openings are respectively at positions opposing one another from the center of a convex surface of the bent disk-shaped plate.

Finally, color lenses 31 in three colors, i.e., red, blue, and green are respectively fitted in the openings 32, to manufacture a plate for lighting device 3.

Manufacture of Lighting Device 1 According to Present Embodiment

First, light projection means 2 were respectively arranged in the openings 32 in the plate for lighting device 3 manufactured in (1-1). Then, a direction and an arrangement of each of the light projection means 2 were adjusted such that the light projection means 2 is inclined by 3 degrees to 15 degrees in a direction toward the center of a lighting device 1 (see FIG. 4). The light projection means 2 adjusted in a desired direction and arrangement and the plate for lighting device 3 were fixed to each other by a supporting section 6 (a support plate 61 and a support rod 62).

Then, the light projection means 2, a converter 5, and wirings 7 were sandwiched between the plate for lighting device 3 and an umbrella section 4 including a suspension member 41, to manufacture the lighting device 1 according to the embodiment.

(2) Example of Irradiation Using Lighting Device 1 According to Present Embodiment When a light is irradiated onto glassware (an article X) on a desk using the manufactured lighting device 1 according to the present embodiment from a height of 60 cm to 70 cm above the desk, three shadows (a cyan shadow Cs, a magenta shadow Ms, and a yellow shadow Ys) having different hues appeared while the glassware was being illuminated with a white mixed color light 22 (FIGS. 1, 2, and 6).

INDUSTRIAL APPLICABILITY

The present invention can be applied to a lighting device.

REFERENCE SIGNS LIST

1 lighting device
2 light projection means
21 spot light
211 optical axis
22 mixed color light
3 plate for lighting device
31 color lens
32 opening
4 umbrella section
41 suspension member
5 converter
6 supporting section
61 support plate
62 support rod
7 wiring
R red
G green
B blue
C cyan
Cs cyan shadow
M magenta
Ms magenta shadow
Y yellow
Ys yellow shadow
W white
X article

The invention claimed is:

1. A lighting device for exhibition having a function of irradiating respective spot lights in two or more colors, wherein the lighting device is a suspending lighting device, and comprises two or more light projectors for respectively irradiating the spot lights, wherein the light projectors respectively are spaced 5 cm or more apart from each other, and the spot lights to be irradiated from the light projectors respectively comprise portions that substantially interfere each other directly below the lighting device, the lighting device further comprising:

a plate for the lighting device including openings for respectively arranging the light projectors, wherein the plate for the lighting device is entirely bent with the center of the plate for lighting device used as a vertex, and the opening are respectively formed to be at positions opposing each other from a center of a convex surface of the bent plate for lighting device.

2. The lighting device according to claim 1, wherein each of the light projectors an LED, and a difference in light quantity between each of RGB colors in an RGB color model in mixed color light obtained when all the spot lights to be respectively projected from the light projectors are color-mixed is within a range of 0% to 35%.

3. The lighting device according to claim 2, wherein the mixed color light obtained when all the spot lights to be respectively projected from the light projectors are color-mixed is white.

4. The lighting device according to claim 1, wherein three or more light projectors for respectively irradiating the spot lights are provided on a substantially identical circumference of the lighting device, and the light projectors respectively provided at positions spaced 15 cm or more apart from one another.

5. The lighting device according to claim 4, wherein each of the light projectors is inclined by 3 degrees to 15 degrees in a direction toward a center of the lighting device.

6. The lighting device according to claim 5, wherein the lighting device is turnable.

7. The lighting device according to claim 2, wherein three or more light projectors respectively irradiating the spot lights are provided on a substantially identical circumference of the lighting device, and the light projectors are respectively provided at positions spaced 15 cm or more apart from one another.

8. The lighting device according to claim 7, wherein each of the light projectors is inclined by 3 degrees to 15 degrees in a direction toward a center of the lighting device.

9. The lighting device according to claim 8, wherein the lighting device is turnable.

10. The lighting device according to claim 3, wherein three or more light projectors for respectively irradiating the spot lights are provided on a substantially identical circumference of the lighting device, and the light projectors are respectively provided at positions spaced 15 cm or more apart from one another.

11. The lighting device according to claim 10, wherein each of the light projectors is inclined by 3 degrees to 15 degrees in a direction toward a center of the lighting device.

12. The lighting device according to claim 11, wherein the lighting device is turnable.

13. The lighting device according to claim 1, wherein two or more light projectors are selected from light emitting diode (LED), halogen lamp, HD lamp, incandescent lamp, silica lamp, or mini-krypton lamp.

* * * * *